US005944494A

United States Patent [19]

Soltani et al.

[11] Patent Number: 5,944,494

[45] Date of Patent: Aug. 31, 1999

[54] BLOWER APPARATUS MOUNTED IN A HOUSING WITHOUT A RIGID CONNECTION

[75] Inventors: Sohrab Soltani, Charleston; David N. Ashcraft, Mt. Pleasant; Timothy W. Perez; James J. Romano, both of James Island, all of S.C.

[73] Assignee: Hill-Rom, Inc., Batesville, Ind.

[21] Appl. No.: 08/840,335

[22] Filed: Apr. 29, 1997

[51] Int. Cl.[6] ..... F04B 35/04

[52] U.S. Cl. ..... 417/312; 417/313; 417/363; 417/423.9; 417/423.14

[58] Field of Search ..... 417/363, 360, 417/313, 423.5, 423.1, 423.9, 423.14, 423.15, 312

[56] References Cited

U.S. PATENT DOCUMENTS

| | | | |
|---|---|---|---|
| D. 344,735 | 3/1994 | Ohman . | |
| 1,071,042 | 8/1913 | Fuller | 417/423.5 |
| 3,195,259 | 7/1965 | Liebmann | 417/423.15 |
| 4,884,946 | 12/1989 | Belanger et al. | 417/360 |
| 5,051,673 | 9/1991 | Goodwin . | |
| 5,052,067 | 10/1991 | Thomas et al. . | |
| 5,181,832 | 1/1993 | Reents | 417/423.9 |
| 5,269,030 | 12/1993 | Pahno et al. . | |
| 5,349,983 | 9/1994 | Ozarowski et al. . | |
| 5,402,542 | 4/1995 | Viard . | |
| 5,407,330 | 4/1995 | Rimington et al. | 417/313 |
| 5,429,306 | 7/1995 | Schneider et al. . | |
| 5,462,415 | 10/1995 | Chen | 417/360 |
| 5,567,127 | 10/1996 | Wentz | 417/312 |
| 5,594,963 | 1/1997 | Berkowitz . | |

*Primary Examiner*—Charles G. Freay
*Attorney, Agent, or Firm*—Barnes & Thornburg

[57] ABSTRACT

An apparatus is configured for mounting a blower motor into a blower housing. The blower housing has an interior region for receiving the blower motor. The apparatus comprises a top shell configured to surround a top portion of the blower motor and a bottom shell configured to surround a bottom portion of the blower motor. The top and bottom shells are configured to hold the blower motor in the interior region of the housing without a rigid connection between the blower motor and the blower housing. The top shell cooperates with the bottom shell to define an air intake manifold to provide flow of intake air to the blower motor.

38 Claims, 9 Drawing Sheets

BLOWER APPARATUS MOUNTED IN A HOUSING WITHOUT A RIGID CONNECTION

BACKGROUND AND SUMMARY OF THE INVENTION

The present invention relates to a blower apparatus. More particularly, the present invention relates to an improved blower apparatus for controlling fluid flow to desired pieces of equipment, such as air mattress or other components of a bed.

Although the illustrated embodiments of the present invention disclose air blowers, it is understood that the present invention may also be useful with other types of fluid.

Blowers for supplying air to air mattresses or other pieces of equipment are typically noisy due to operation of the blower motor and due to the intake of air into the blower. It is desirable to reduce the noise output from blowers which are often used next to a bed.

The present invention is designed to minimize noise output from a blower apparatus. According to the present invention, a first blower assembly is provided for supplying air to a low air loss mattress. Such a blower assembly typically requires a relatively large blower motor. The present invention provides an improved mounting apparatus for locating the blower motor within a blower housing without providing a rigid connection between the blower motor and the blower housing. This reduces housing vibration and the associated noise of the blower motor.

A second blower apparatus is also provided. The second blower apparatus is for controlling a second piece of equipment, such as an articulating deck assembly configured to be located below the air mattress. The second blower assembly motor is typically smaller than the blower motor required to control an air mattress. The second motor is mounted to the second housing using vibration mounts. The second blower assembly includes an improved air intake manifold and intake ring designed to reduce noise associated with air entering the second blower motor.

Another feature of the present invention is a modular or stackable arrangement for the first and second blowers. The first blower apparatus can be stacked on top of the second blower apparatus to form a single modular unit for controlling both the first and second pieces of equipment. The modular unit can be placed adjacent a bed to control both the air mattress and the articulating deck or other desired pieces of equipment. The first blower apparatus includes a retracting mounting bar which can be extended from the first blower housing to connect the modular unit to a foot board of a bed or other support if desired. The first and second blower apparatus can also be positioned on the floor adjacent the bed on their backs, if desired.

According to one aspect of the present invention, an apparatus is provided for mounting a blower motor into a blower housing having an interior region for receiving the blower motor. The apparatus includes a top shell configured to surround a top portion of the blower motor, and a bottom shell configured to surround a bottom portion of the blower motor, the top and bottom shells being configured to hold the blower motor in the interior region of the housing without a rigid connection between the blower motor and the blower housing.

In the illustrated embodiment, the top and bottom shells are made from a foam material such as a polystyrene foam.

The top and bottom shells are formed from an air impermeable material.

Also in the illustrated embodiment, the top shell cooperates with the bottom shell to define an air intake manifold to provide flow of intake air to the blower motor. The top shell includes a top end wall and the bottom shell includes a bottom end wall spaced apart from the top end wall to deflect intake air along a predetermined path in the intake manifold. In an alternative embodiment, the top and bottom shells cooperate to define an outlet manifold in communication with an outlet of the blower motor.

The illustrated blower motor has a top surface formed to include an air inlet aperture. The top shell has an inner surface located above the top surface of the blower motor. The inner surface is formed to include a recessed portion located over the inlet aperture to permit intake air to enter the inlet aperture.

According to another aspect of the present invention, a blower apparatus is provided for supplying fluid to a piece of equipment. The apparatus includes a housing for holding the blower motor. The housing includes a wall, a fluid inlet, and a fluid outlet. The apparatus also includes a mounting bar coupled to the wall of the housing. The mounting bar is movable relative to the housing from a retracted storage position to an extended position to couple the housing to a support.

In the illustrated apparatus, the wall of the housing is formed to include a recessed portion for receiving the mounting bar when the mounting bar is in its retracted position. The mounting bar is located in the recessed portion below a surface of the wall when the mounting bar is in its retracted position.

The illustrated mounting bar is coupled to the housing by a spring mount assembly to bias the mounting bar to the retracted position. The mounting bar includes a U-shaped portion having first and second arms which extend into first and second elongated channels formed in the housing. The apparatus also includes first and second slide members coupled to the first and second arms, respectively. The first and second slide members are located in the first and second elongated channels. First and second fasteners are provided for securing the first and second arms to the housing. First and second springs are located on the first and second arms between the first and second slide members and the first and second fasteners, respectively, to bias the mounting bar to its retracted position.

According to yet another aspect of the present invention, a blower assembly includes a first blower apparatus for supplying fluid to a first piece of equipment, and a second blower apparatus for supplying fluid to a second piece of equipment. The first blower apparatus includes a housing having a base, and the second blower apparatus includes a housing having a retention portion configured to couple the base of the first housing to the second housing.

The illustrated base includes a foot portion, and the second housing is formed to include a recessed portion having a lip for engaging the foot portion of the base. The foot portion is formed along a front edge of the base, and the lip is formed along at least a front edge of the recessed portion of the second housing. A fastener is located along a rear wall of the first and second housings to secure the first housing to the second housing.

The illustrated assembly further includes an electrical connector for electrically coupling the first housing to the second housing. The second housing includes a base for coupling the second housing to a third housing.

According to a further aspect of the present invention, an apparatus is provided for reducing noise of intake air into an aperture formed in a wall of a blower motor. The apparatus includes a ring including an annular outer flange having a dimension larger than the aperture in the wall of the blower motor, an annular inner portion configured to extend through the aperture, and a tapered surface extending between the outer flange and the inner portion to minimize noise caused by air entering the blower motor through the aperture.

A distal end of the inner portion illustratively has a dimension larger than the aperture. The inner portion is flexible to permit the inner portion to be inserted into the aperture so that the inner portion retains the ring on the wall of the blower motor.

The illustrated apparatus further includes an intake manifold having a front wall formed to include an outlet opening. The outer flange of the ring is configured to engage the front wall of the manifold to secure the manifold to the blower motor. The distal end of the inner portion of the ring passes through the outlet opening of the manifold and into the aperture of the blower motor so that the inner portion of the ring retains the ring and the intake manifold on the wall of the blower motor.

The illustrated intake manifold includes a baffle to direct air flow through the intake manifold. The intake manifold includes a rear wall and a side wall extending between the front wall and rear wall. The side wall is formed to include an air inlet opening. Sound deadening foam located within an interior region of the manifold adjacent the front and rear walls.

According to a still further aspect of the present invention, a blower apparatus includes a housing for holding a blower motor. The housing has an air outlet and a recessed grate formed to include a plurality of slots spaced apart along an axis to provide an air inlet. The apparatus also includes a filter located over the recessed grate, and cover coupled to the housing over the recessed grate and filter. The cover is formed to include a plurality of slots spaced apart along the axis. The slots of the cover being axially spaced apart from the slots in the recessed grate.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
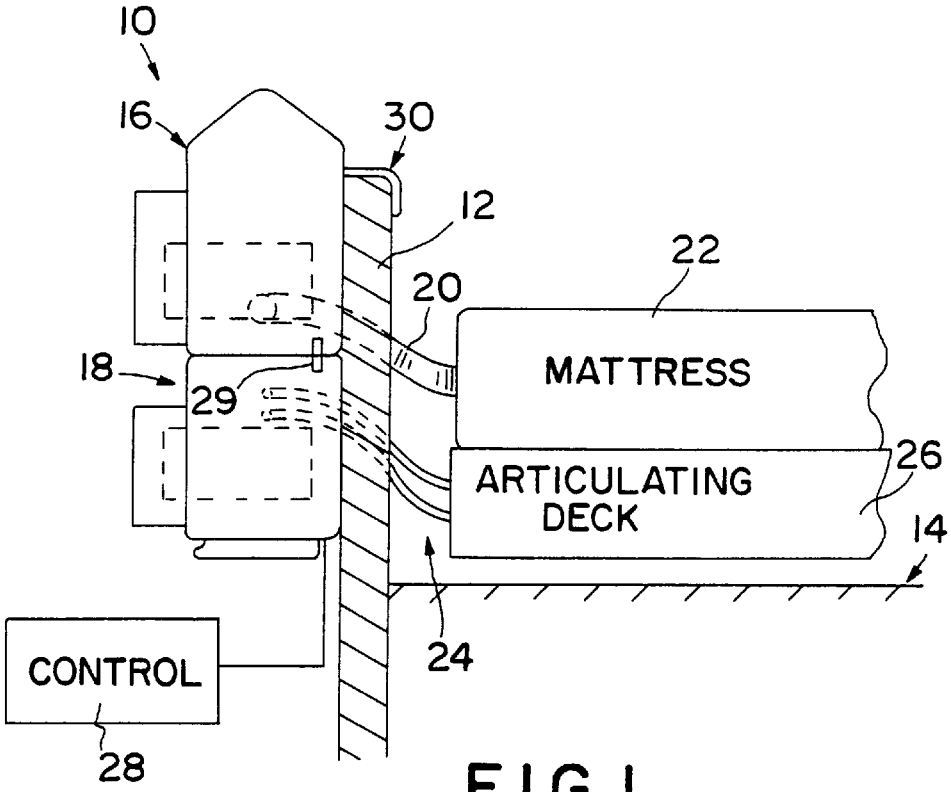
FIG. 1 is a diagrammatical view illustrating a modular blower assembly including a first blower apparatus for controlling an air mattress and a second blower apparatus coupled to the first blower apparatus for controlling an articulating deck, with the modular blower assembly being coupled to a foot board of a bed.

Referring now to the drawings, FIG. 1 illustrates a blower assembly 10 of the present invention mounted on a foot board 12 of a bed 14. The blower assembly includes a first blower apparatus 16 and a second blower apparatus 18. As discussed below, the first blower apparatus 16 and the second blower apparatus 18 are modular units which can be stacked on top of each other to form the blower assembly 10. The first blower apparatus 16 includes an outlet 20 for providing air flow to an air mattress 22. Preferably, mattress 22 is a low air loss air mattress. One suitable air mattress is disclosed in U.S. Pat. No. 5,794,288.

A second blower apparatus 18 has outlet lines 24 for controlling other pieces of equipment, such as an articulating deck 26 located below the mattress 22. Illustratively, the articulating deck may include bellows for raising and lowering portions of the mattress. One such articulating deck is illustrated in U.S. application Ser. No. 08/841,125, filed Apr. 29, 1997, the disclosure of which is hereby incorporated by reference.

A controller 28 is electrically coupled to the blower assembly 10. Illustratively, controller 28 is a patient pendant to provide remote control patient inputs. An electrical connector 29 is provided for electrically coupling first blower apparatus 16 to second blower apparatus 18.

Figure 2:
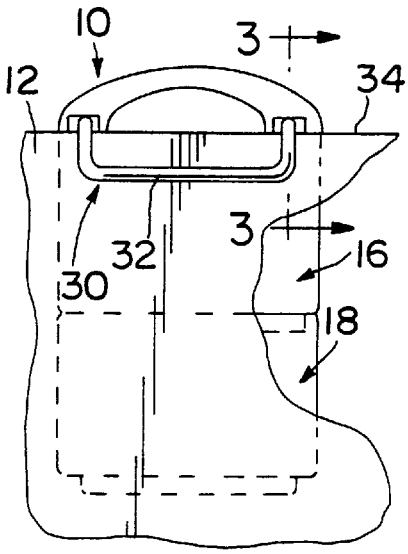
FIG. 2 is a partial rear view of FIG. 1 further illustrating a mounting bar, for coupling the blower assembly to the foot board of the bed.

The blower assembly 10 may be coupled to foot board 12 or other support by an extendable and retractable mounting bar 30. The mounting bar 30 is further illustrated in FIGS. 2 and 4. As illustrated in FIGS. 2 ans 4 the mounting bar includes a downwardly extending U-shaped portion 32 configured to be located over a top end 34 of foot board 12 to couple the blower assembly 10 to the foot board 12.

Figure 3:
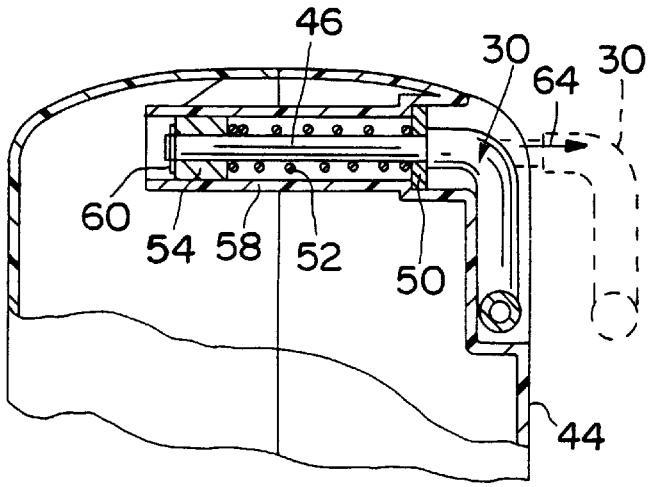
FIG. 3 is a sectional view taken along lines 3—3 of FIG. 2, further illustrating details of the extendable mounting bar assembly coupled to a housing of the first blower apparatus.
Figure 4:
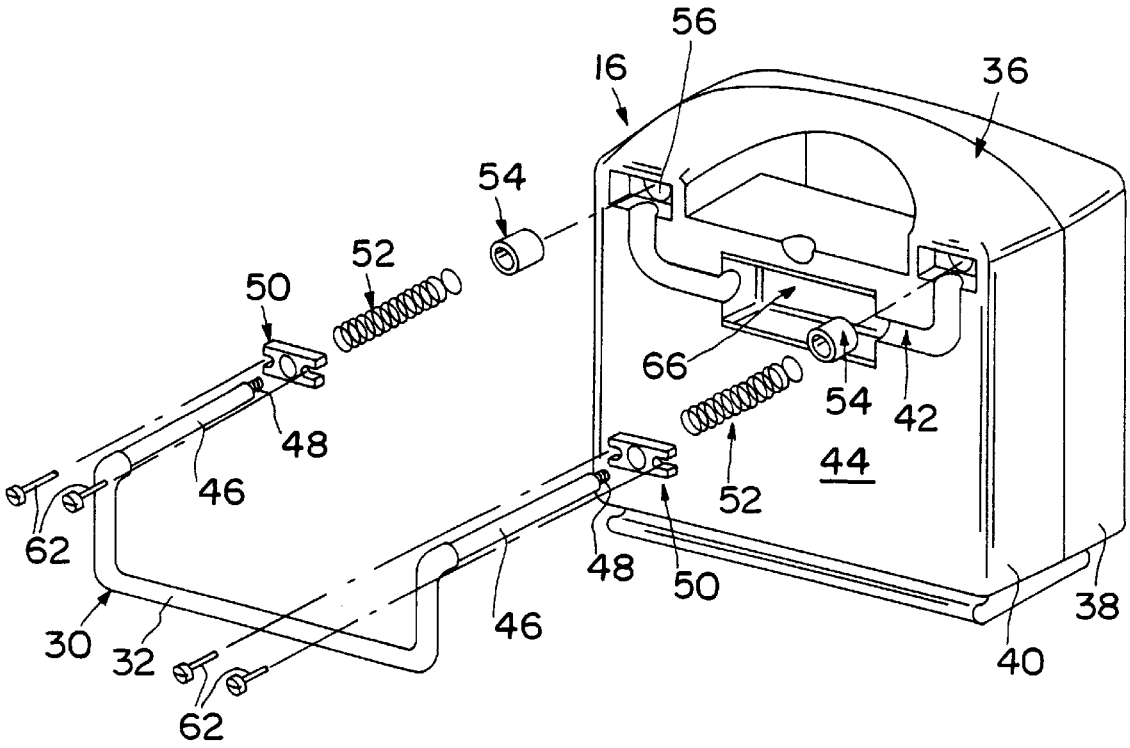
FIG. 4 is an exploded perspective view illustrating further details of the mounting bar assembly and the first blower apparatus.

Additional details of the mounting bar assembly are illustrated in FIGS. 3 and 4. First blower apparatus 16 includes a housing 36 having front and rear housing portions 38 and 40. Rear housing portion 40 is formed to include a recessed area 42 for receiving the mounting bar 30 in its retracted position. As illustrated in FIG. 3, the mounting bar is located at or below a rear surface 44 of rear housing portion 40 when the mounting bar 30 is in its retracted position.

The mounting bar 30 includes arms 46 coupled to U-shaped portion 32. Opposite ends of arms 46 include threads 48. Each arm 46 extends through a fastener 50, a spring 52, a sliding cylinder 54, and to an aperture 56 formed by open tubes 58 formed in the rear housing portion 40. A suitable fastener 60, such as a nut, holds the sliding cylinder 54 and spring 52 on the arms 46. Plates 50 are secured to the rear housing portion 40 by fasteners 62. Spring 52 biases the mounting bar 30 to a normally retracted position illustrated in solid lines in FIG. 3.

When it is desired to mount the blower apparatus 16 on to a bed 14, an operator pulls the mounting bar 30 outwardly in the direction of arrow 64 of FIG. 3 to the extended position illustrated by dotted lines. Rear housing portion 40 includes an expanded recessed section 66 to permit an operator to grab a portion of the mounting bar 30 and move the mounting bar 30 to its extended position. The operator can then hook the extended mounting bar 30 over a support.

As discussed above, the first blower apparatus 16 is used to supply air or other fluid to a mattress 22 through supply tube 20. A problem associated with conventional blower assemblies is that the blower assemblies generate a large amount of noise due to operation of a blower motor in the intake of air through the blower assembly.

Figure 5:
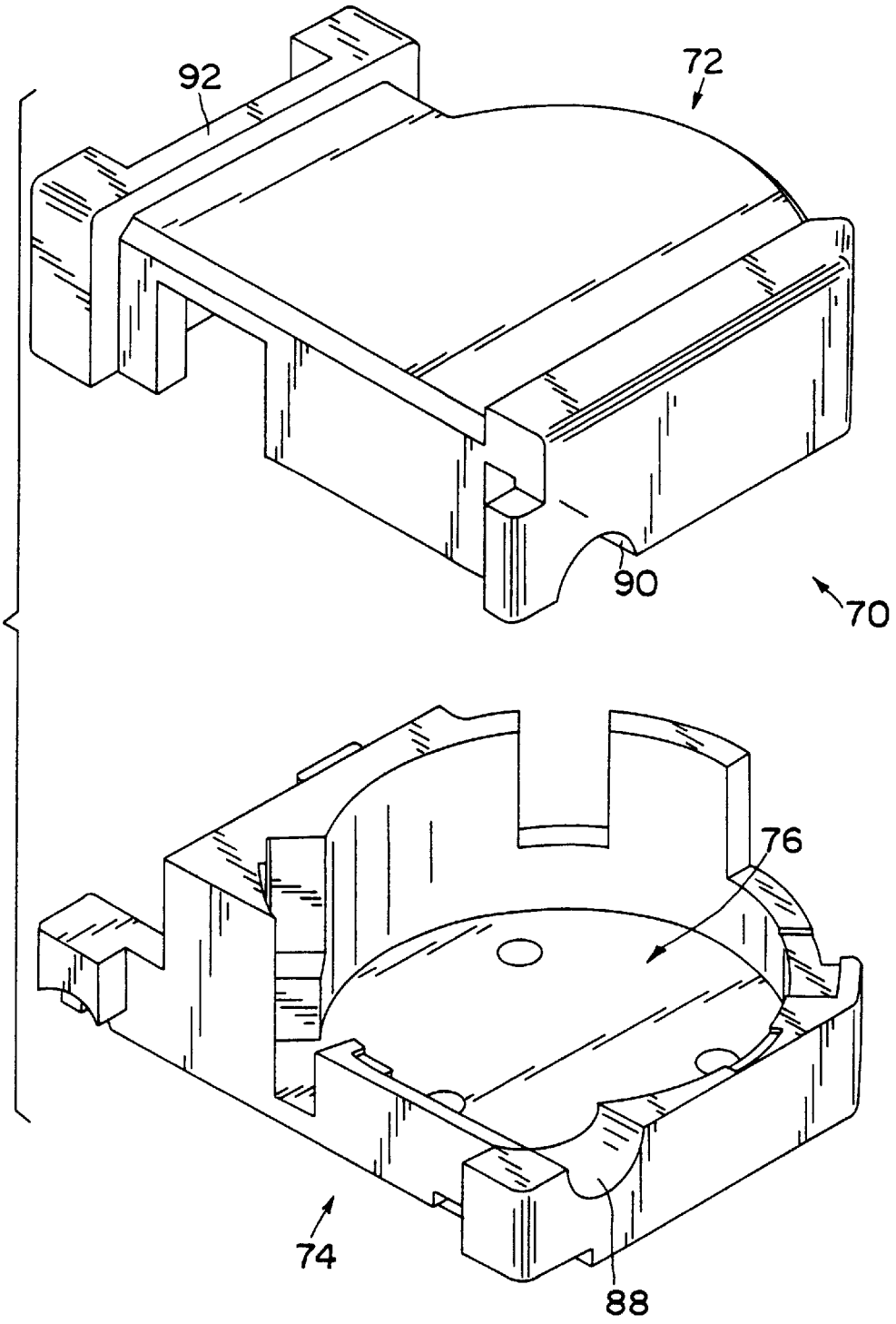
FIG. 5 is an exploded perspective view illustrating top and bottom shell segments of a foam shell configured to surround a blower motor for mounting the blower motor within a housing of the first blower apparatus without rigidly coupling the blower motor to the blower housing.
Figure 6:
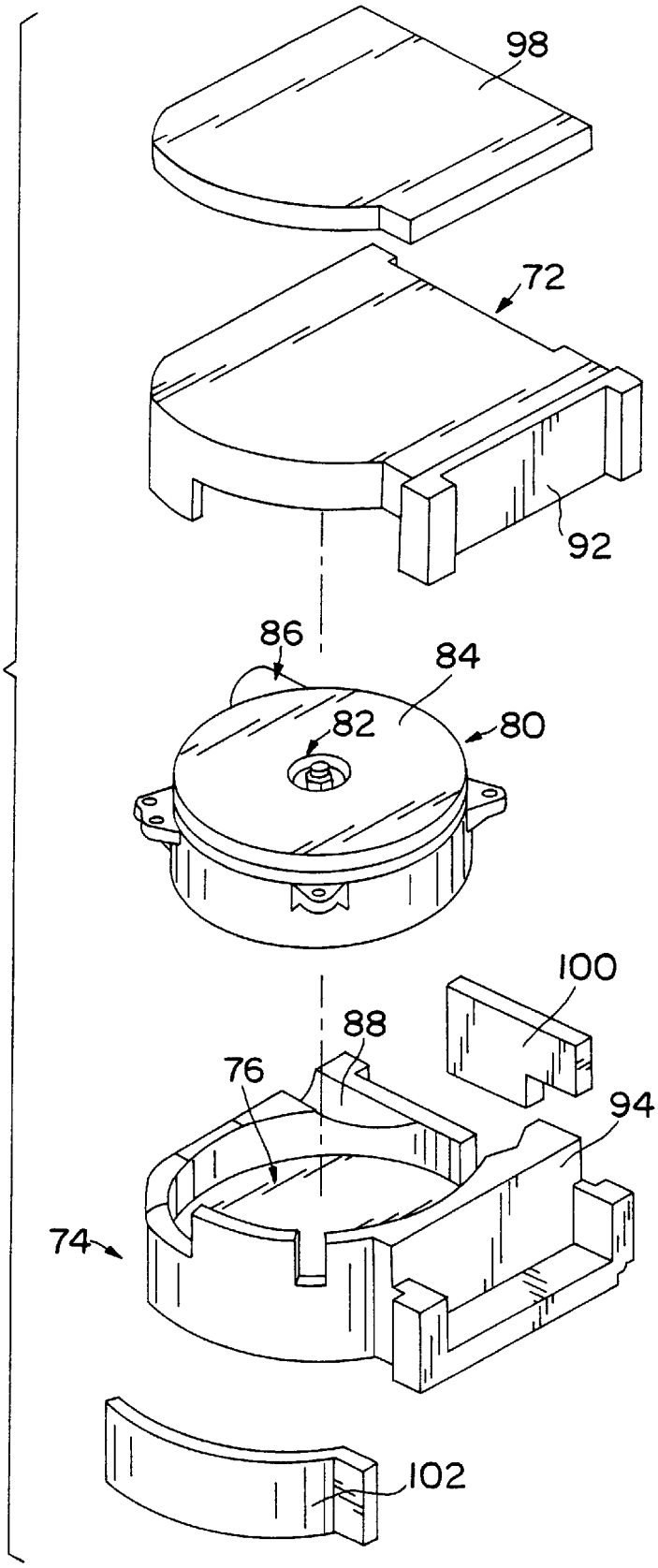
FIG. 6 is an exploded perspective view illustrating further details of the top and bottom foam shells, the blower motor, and sound foam located adjacent the top and bottom shells for mounting the blower motor in the first blower housing.

The present invention provides an improved mounting assembly for mounting a blower motor into a housing. FIG. 5 illustrates a motor mounting assembly 70 including a top foam shell 72 and a bottom foam shell 74. Illustratively, shells 72 and 74 are made from a polystyrene material. Bottom foam shell 74 is formed to include a recessed portion 76 for receiving a blower motor 80 as shown in FIG. 6. Blower motor 80 includes a motor positioned within a housing having an air intake opening 82 formed in a top surface 84 and an air outlet 86. Top and bottom foam shells 72 and 74 are configured to receive and surround the blower motor 80. The sound deadening foam material of shells 72 and 74 reduces noise of blower motor 80. Bottom shell includes a curved outlet portion 88 and top shell 72 includes a curved section 90 for receiving outlet 86 of blower motor 80. Top foam shell 72 includes a rear wall 92, and bottom shell 74 includes a rear wall 94. Rear wall 92 is spaced apart from rear wall 94 to define an air flow channel or intake manifold through the foam mounting assembly as discussed in detail below.

Figure 7:
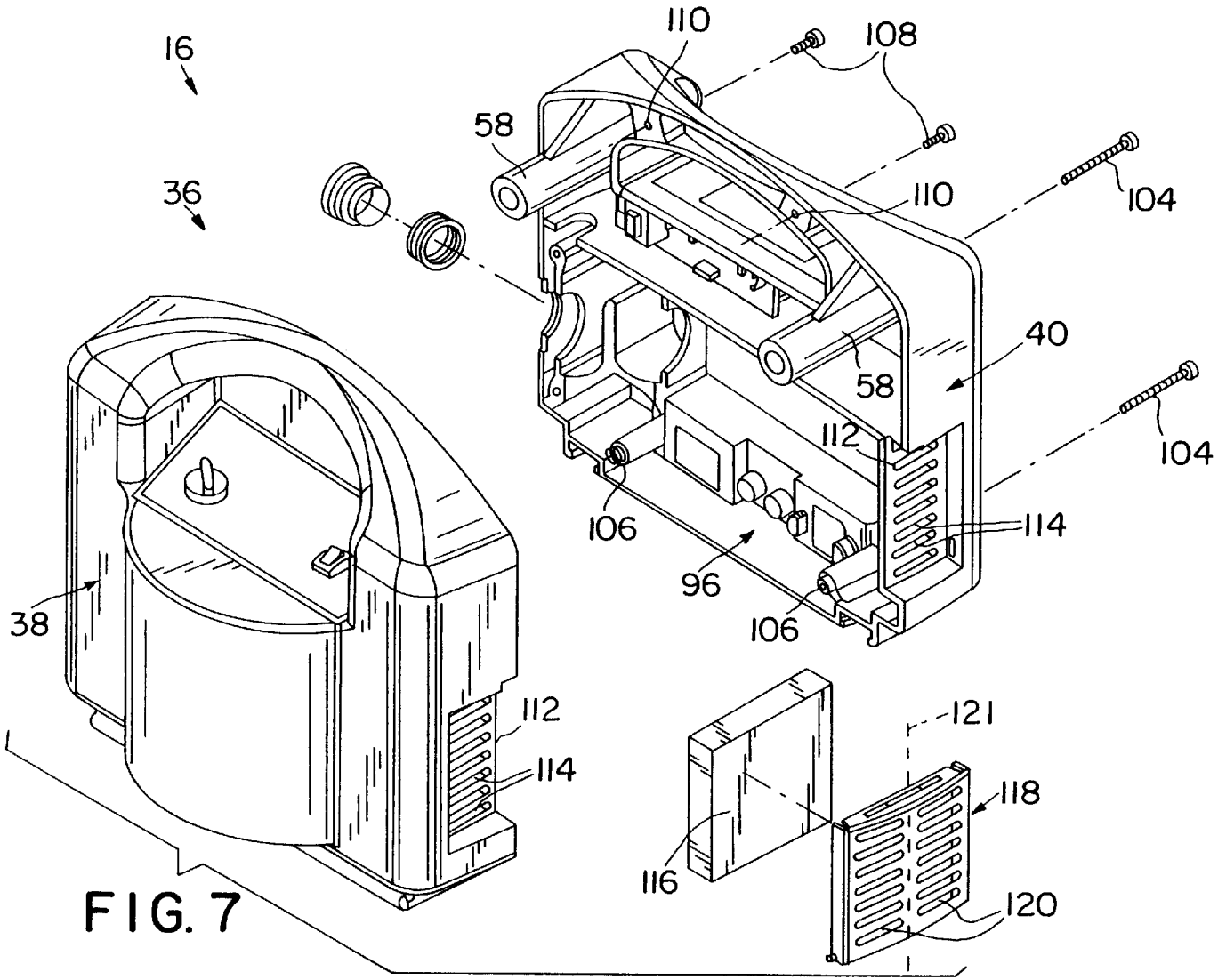
FIG. 7 is a exploded perspective view of the first blower housing for receiving the components illustrated in FIG. 6.

FIG. 7 illustrates further details of the housing 36 of first blower apparatus 16. Housing 36 includes an interior region 96 for receiving the foam blower mounting assembly 70 therein. After the foam blower mounting assembly 70 containing the blower 80 is inserted into the interior region 96 of housing 36, sound foam components 98, 100, and 102 (FIG. 6) may be positioned around the foam mounting assembly 70, if desired. Once the foam shell assembly 70 and blower 80 are positioned within the interior region 96 of housing 36, front and rear housing portions 38 and 40 are coupled together with suitable fasteners 104 which extend through apertures 106 and suitable fasteners 108 which extend through apertures 110. The mounting assembly 70 therefore eliminates the requirement for fastening the blower motor 80 directly to the blower housing 36. This reduces noise caused by blower vibration.

Figure 9:
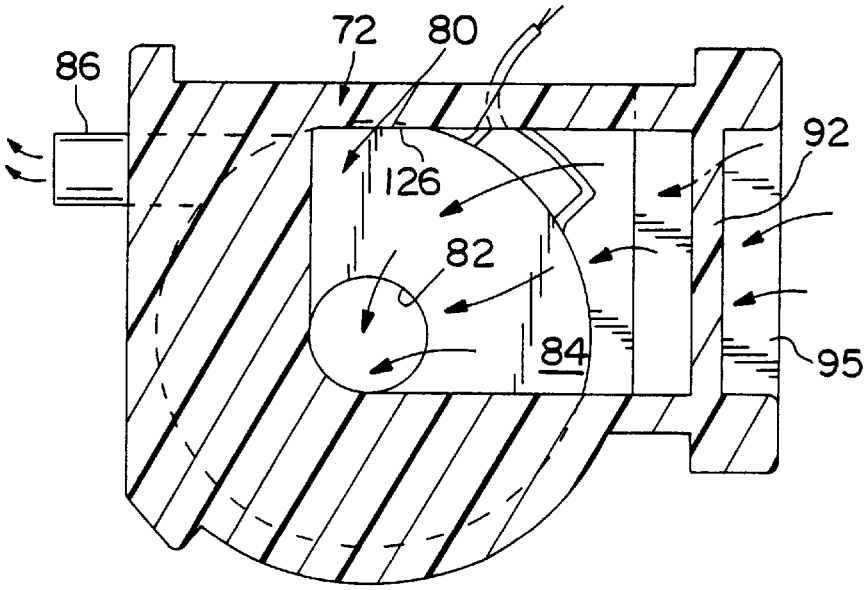
FIG. 9 is a sectional view taken along lines 9—9 of FIG. 8 illustrating further details of the top foam shell.

As discussed above, the foam shells 72 and 74 include spaced apart end walls 92 and 94, respectively. These end walls 92 and 94 cooperate to define an air intake passageway or manifold including baffles for changing the direction of inlet air entering the housing 36 to decrease the noise caused by the intake air. After the air enters through cover 118, filter 116, and slots 114 of grate 112, air is deflected downwardly 90° by wall 92 of top shell 72. Intake air then deflects upwardly 90° in the direction of arrow 124 by end wall 94 of lower shell 74. Top shell 72 is formed to include a recessed portion 126 located above top surface 84 of blower motor 80 so that air can enter recessed portion 126 in the direction of arrows 128 and then enter air inlet 82 of blower motor 80 in the direction of arrows 130. Further details of the recessed portion 126 in communication with the air inlet 82 on top surface 84 of blower motor 80 are illustrated in FIG. 9.

Air exiting outlet 86 of blower motor 80 is directed upwardly by a baffle 132. Air is then directed downwardly and out through openings 138 and 140.

The foam shell assembly 70 therefore provides structure for mounting of the blower motor 80 within housing 36, provides sound deadening features around the blower motor 80, and also provides an air intake manifold for deflecting and routing the intake air to reduce noise. The blower motor 80 is not rigidly coupled to the housing 36. This decreases noise due to vibration of the blower motor 80. In addition, since the molded foam shells 72 and 74 provide a passageway which makes the intake air change directions 90°, no additional baffling is required to be formed within the housing 36 to provide an intake manifold.

The outlet manifold illustrated by walls 132 and 139 can also be formed as part of the foam shell housing assembly 70, if desired. Walls similar to walls 92 and 94 are formed at the outlet end of shells 72 and 74 to provide an outlet manifold.

Figure 8:
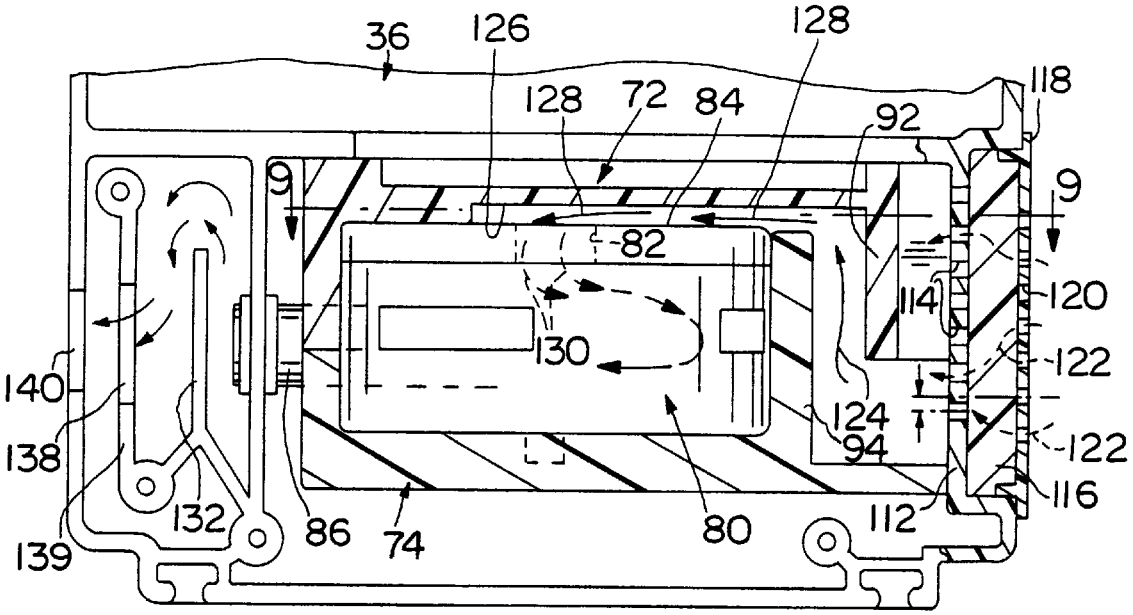
FIG. 8 is a sectional view taken through a portion of the first blower housing further illustrating the configuration of the top and bottom shells and illustrating air flow through the shells, into the blower motor, and through an outlet of the blower housing.

Front and rear housing portions 38 are each formed to include a recessed grate 112 having elongated slots 114. Once the housing is assembled, a filter 116 is positioned over the recessed grate 112 and an outer cover 118 is positioned over the filter attached to housing 36. Cover 118 includes elongated slots 120 which permit air flow into the housing 36 as discussed below. The slots 120 in the outer cover 118 are vertically offset along axis 121 from the slots 114 formed in inner grate 112 as best illustrated in FIG. 8. The non-symmetrical, offset slots 120 and 114 provide noise reduction by changing the direction of intake air. The offset slots 120 and 114 also permit the filter 116 to be flipped over and used again due to the curved air flow pattern between the offset slots 120 and 114 as illustrated by arrows 122 of FIG. 8.

Figure 10:
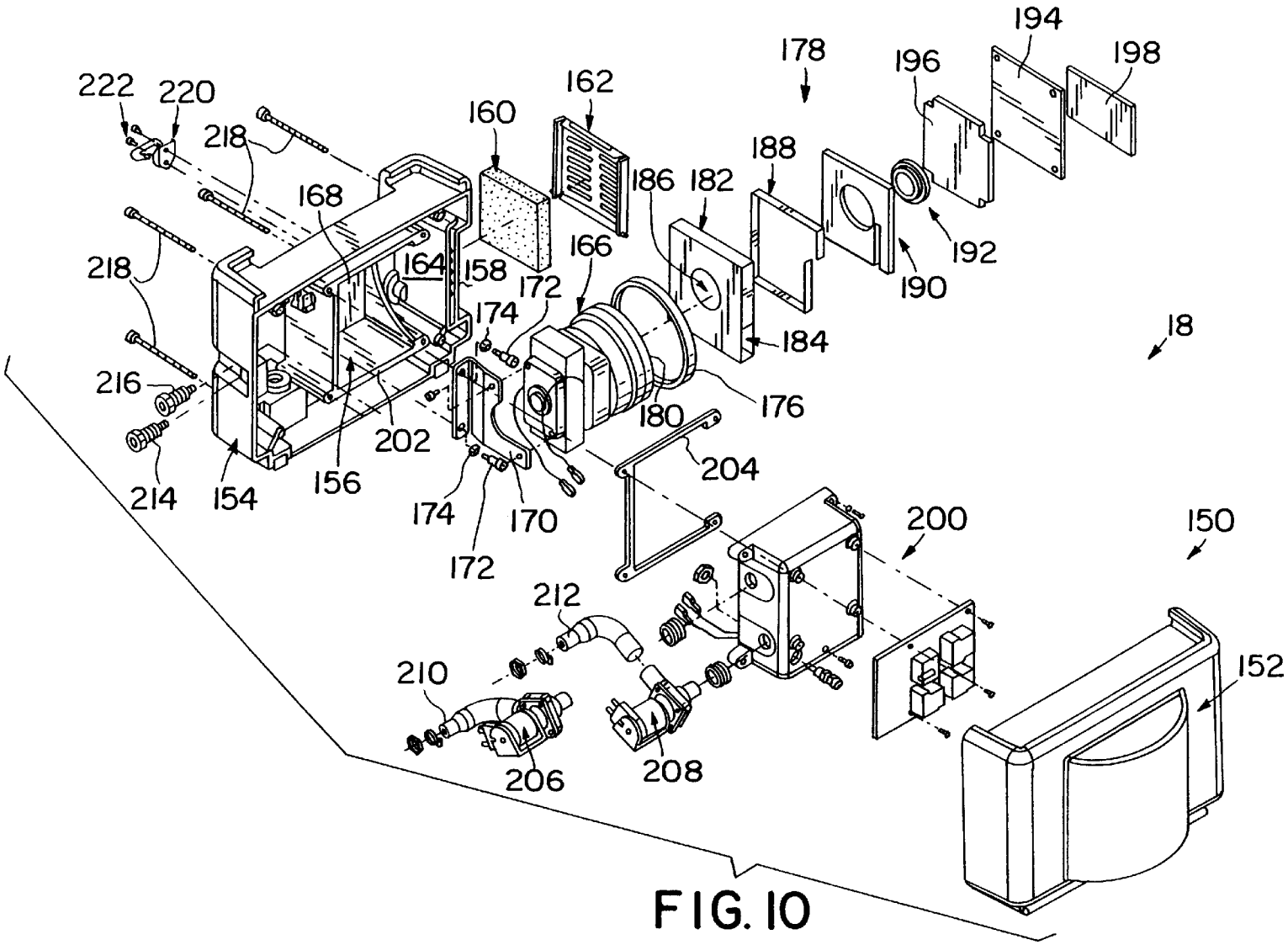
FIG. 10 is an exploded perspective view of the second blower apparatus.

Details of the second blower apparatus 18 of the present invention are illustrated in FIG. 10. The second blower apparatus 18 includes a blower housing 150 having a front housing portion 152 and a rear housing portion 154. Front and rear housing portions 152 and 154 define an interior region for holding the blower motor 166 and control components of the blower apparatus 18.

Front and rear housing portions 152 and 154 are formed to include a recessed grate 158 similar to the grate 112 discussed above with reference to FIG. 7. After the front and rear housing portions 152 and 154 are connected together, a filter 160 is located over grate 158, and an outer cover 162 is coupled over to housing 150 over the filter 160 as discussed above. A baffle 164 is spaced apart from grate 158 to direct intake air upwardly within the housing 150.

Blower motor 166 is mounted within an interior region 156. Blower motor 166 is mounted to a rear surface 168 by a mounting plate 170, fasteners 172, and vibration mounts 174. An elastomeric ring 176 is mounted around an outer periphery of blower motor 166 to seal and reduce vibration transfer from the motor 166 to the housing 150. An intake manifold assembly 178 is mounted to an inlet end 180 of blower motor 166. Manifold assembly 178 includes a metal frame 180 having an air inlet aperture 184 along one side of the frame 182, and a central air outlet aperture 186. An air guide track or baffle 188 is located within frame 182 to deflect inlet air. A layer of sound deadening foam 190 is located within frame 182. A sound reduction intake ring 192, discussed in detail below, is also located within the manifold assembly 178 for coupling the frame 182 to the wall 180 of blower motor 166. Manifold assembly 178 further includes an outer metal plate 194 configured to be coupled to frame 182. A layer of sound deadening foam 194 is located on an inside surface of plate 194. Another layer of sound deadening foam 198 is located on outside surface of metal plate 194.

An outlet manifold and control housing 200 is mounted to a support 202 of rear housing portion 154 by suitable fasteners. A gasket 204 is located between support 202 and housing 200. Solenoid valves 206 and 208 provide control of air flow through to air outlets 210 and 212, respectively. Outlet connectors 214 and 216 are coupled to rear housing portion 154 and to outlets 210 and 212, respectively. Rear housing portion 154 is coupled to front housing portion 152 by suitable fasteners 218. A latch 220 is also coupled to rear housing portion 154 by suitable fasteners 222.

Figure 11:
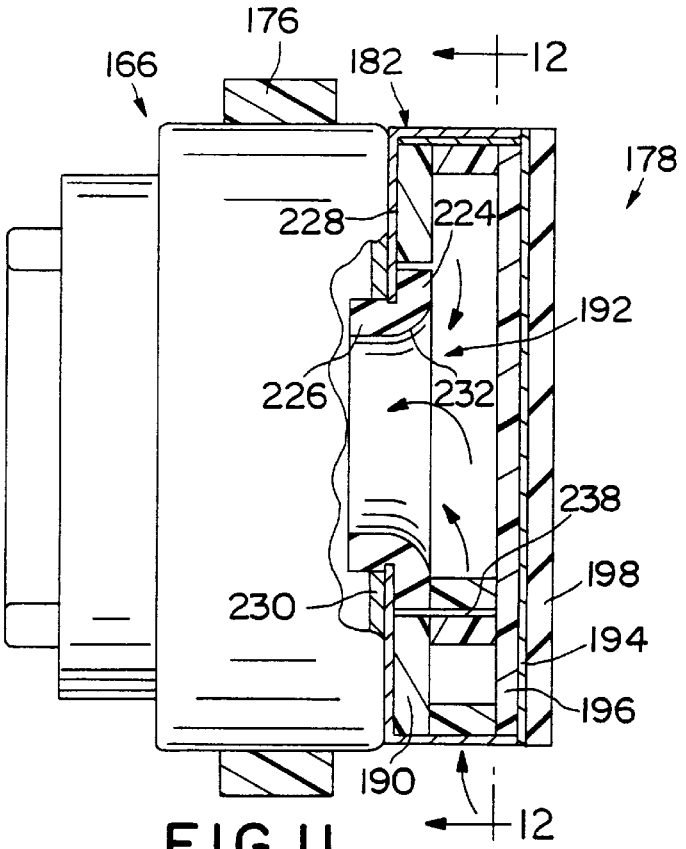
FIG. 11 is a partial sectional view illustrating an air intake ring and manifold assembly coupled to an inlet of a blower motor of the second blower apparatus to reduce air intake noise.

The intake manifold assembly 178 is configured to be mounted to the intake end 180 of blower motor 166 as best illustrated in FIG. 11. Intake ring 192 includes an annular outer flange 224 and an annular inner portion 226. The outer flange 224 is configured to abut a wall 228 of manifold frame 182. Flange 224 has an outer diameter larger than a diameter of aperture 186 formed in frame 182. Inner portion 226 of intake ring 192 is configured to pass through aperture 186. Portion 226 of ring 192 has a diameter slightly larger than a diameter of intake aperture 230 of blower motor 166. Therefore, intake ring 192 is snap-fit into the aperture 230 of blower motor 166 to secure the intake manifold 178 and the ring 192 to blower motor 166. In some instances, the ring 192 can be coupled directly to the blower motor 166.

Intake ring 192 includes a tapered transition surface 232 between the outer flange 224 and inner portion 226. This tapered or curved surface 232 provides a smooth transition for intake air into the blower motor 166. By minimizing rough abrupt edges, the air intake noise is reduced by the ring 192.

Figure 12:
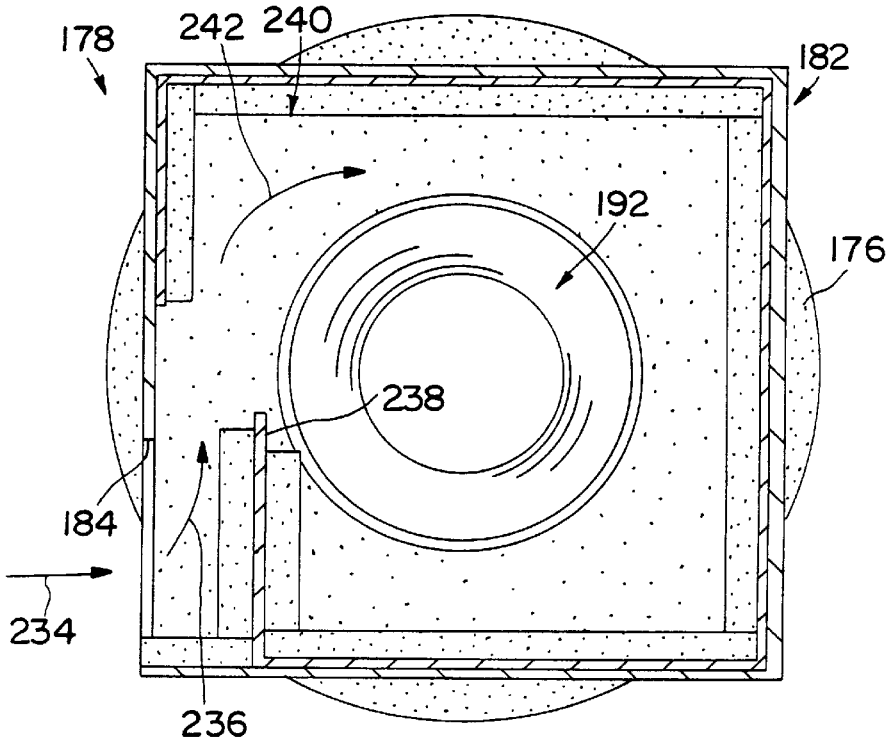
FIG. 12 is a sectional view taken along lines 12—12 of FIG. 11 illustrating further details of the air intake manifold and intake ring.

In addition, air must pass through intake manifold 178 as best illustrated in FIG. 12. Specifically, air enters aperture 184 in air intake manifold 178 in the direction of arrow 234. Intake air is then deflected upwardly through a 90° turn in the direction of arrow 236 by baffle 238. Top wall 240 then deflects air inwardly 90° in the direction of arrow 242. Such deflection of intake air by manifold 178 also reduces air intake noise.

Figure 14:
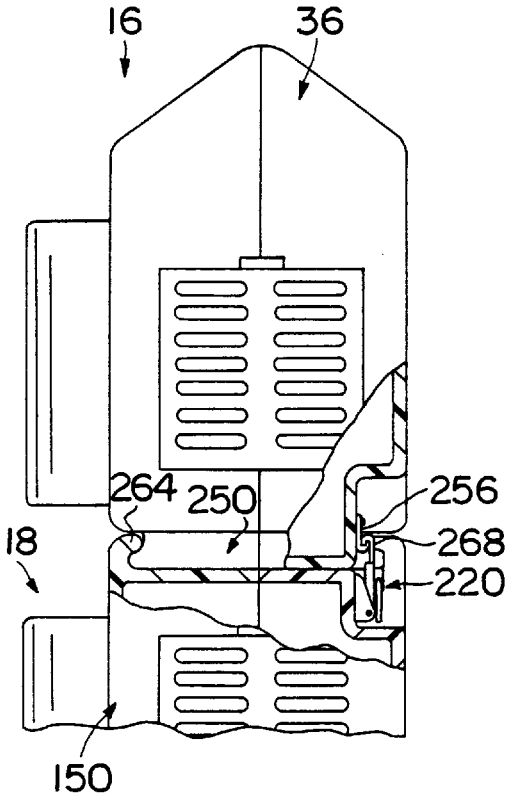
FIG. 14 is a partial side elevational view, with portions broken away, illustrating the first blower apparatus installed on to and locked into engagement with the second blower apparatus.
Figure 13:
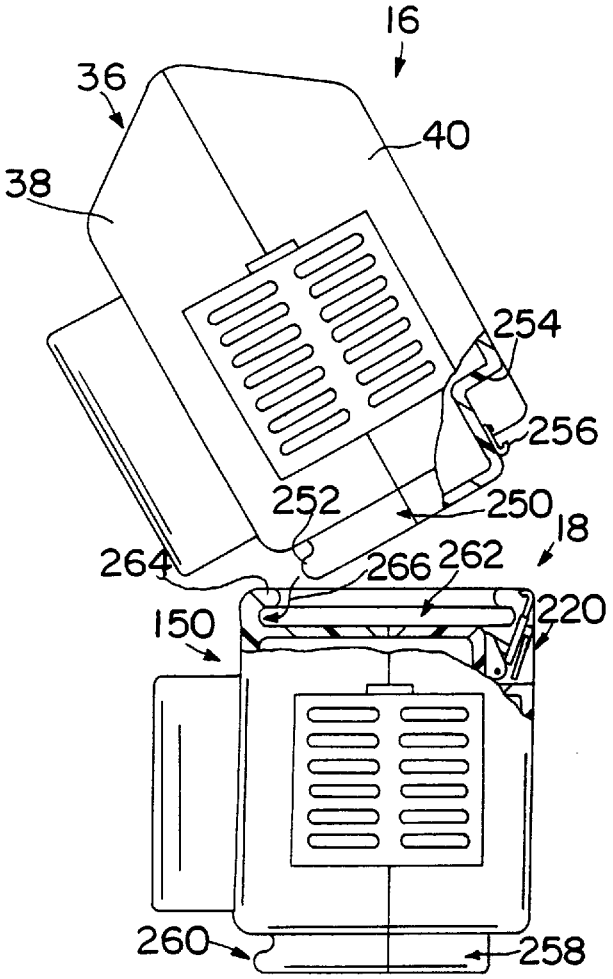
FIG. 13 is an end elevation view, with portions broken away, illustrating attachment of the first blower apparatus to the second blower apparatus to form the modular blower assembly of the present invention.

FIGS. 13 and 14 further illustrate the modular, stacking feature of the present invention. Housing 36 of first blower apparatus 16 is formed to include a base 250. Base 250 includes an extended foot section 252 formed on front housing portion 38. Rear housing 40 includes a recessed portion 254 having a hook 256 mounted thereon.

Housing 150 of second blower apparatus 18 is formed to include a base 258 having a front foot portion 260 identical to base 250 of first blower apparatus 16. Housing 150 is also formed to include a top recessed portion 262 having an outer lip 264.

When it is desired to stack the first blower apparatus 16 on the second blower apparatus 18, the base 250 of first blower apparatus 16 is inserted into the recessed portion 262 of second blower apparatus 18. The foot portion 252 is inserted below the front lip 264 in the direction of arrow 266. First blower apparatus 16 is then pivoted downwardly to the position illustrated in FIG. 14 with the base 250 nested within the recessed portion 262 of housing 150. A hook portion 268 of latch 220 engages hook portion 256 on housing 36 to secure the first blower apparatus 16 to the second blower apparatus 18.

Since the second blower apparatus 18 also includes a base portion 258, the second blower apparatus 18 may be coupled to a recessed top of another blower apparatus (not shown) identical to the shape of the second blower apparatus 18. This modular feature allows any desired number of blowers to be connected together to form a modular unit. Since the first blower apparatus 16 and second blower apparatus 18 are coupled together, the entire blower assembly 10 can be mounted to a foot board 12 of bed 14 or other supports, if desired. The blower assembly 10 can also be located adjacent bed 14 on its back.

Although the invention has been described in detail with reference to a certain preferred embodiment, variations and modifications exist within the scope and spirit of the present invention as described and defined in the following claims.

What is claimed is:

1. An apparatus for mounting a blower motor into a blower housing having an interior region for receiving the blower motor, the apparatus comprising a top shell configured to surround a top portion of the blower motor, and a bottom shell configured to surround a bottom portion of the blower motor, the top and bottom shells being configured to hold the blower motor in the interior region of the housing without a rigid connection between the blower motor and the blower housing, the top shell cooperating with the bottom shell to define an air intake manifold to provide flow of intake air to the blower motor.

2. The apparatus of claim 1, wherein the top and bottom shells are made from a foam material.

3. The apparatus of claim 1, wherein the top shell includes a top end wall and the bottom shell includes a bottom end wall spaced apart from the top end wall to deflect intake air along a predetermined path in the intake manifold.

4. The apparatus of claim 1, wherein the top and bottom shells are formed from a sound deadening material.

5. The apparatus of claim 1, wherein the blower motor has a top surface formed to include an air inlet aperture, the top shell having an inner surface located above the top surface of the blower motor, the inner surface being formed to include a recessed portion located over the inlet aperture to permit intake air to enter the inlet aperture.

6. The apparatus of claim 1, wherein the top and bottom shells cooperate to define an outlet manifold in communication with an outlet of the blower motor.

7. The apparatus of claim 1, wherein the top and bottom shells are formed from an air impermeable material.

8. A blower apparatus for supplying fluid to a piece of equipment, the apparatus comprising:

a housing for holding the blower motor, the housing including a wall, a fluid inlet, and a fluid outlet; and a mounting bar coupled to the wall of the housing, the mounting bar being movable relative to the housing from a retracted storage position to an extended position to couple the housing to a support.

9. The apparatus of claim 8, wherein the wall of the housing is formed to include a recessed portion for receiving the mounting bar when the mounting bar is in its retracted position.

10. The apparatus of claim 9, wherein the mounting bar is located in the recessed portion below a surface of the wall when the mounting bar is in its retracted position.

11. The apparatus of claim 8, wherein the mounting bar is coupled to the housing by a spring mount assembly to bias the mounting bar to the retracted position.

12. The apparatus of claim 8, wherein the mounting bar includes a U-shaped portion having first and second arms which extend into first and second elongated channels formed in the housing.

13. The apparatus of claim 11, further comprising first and second slide members coupled to the first and second arms, respectively, the first and second slide members being located in the first and second elongated channels, and first and second fasteners for securing the first and second arms to the housing.

14. The apparatus of claim 13, further comprising first and second springs located on the first and second arms between the first and second slide members and the first and second fasteners, respectively, to bias the mounting bar to its retracted position.

15. The apparatus of claim 12, wherein the U-shaped portion extends downwardly from the first and second arms.

16. A blower assembly comprising:

a first blower apparatus for supplying fluid to a first piece of equipment, the first blower apparatus including a first housing having a base; and a second blower apparatus for supplying fluid to a second piece of equipment, the second blower apparatus including a second housing having a retention portion configured to couple the base of the first housing to the second housing.

17. The assembly of claim 16, wherein the base includes a foot portion, and the second housing is formed to include a recessed portion having a lip for engaging the foot portion of the base.

18. The assembly of claim 17, wherein the foot portion is formed along a front edge of the base, and the lip is formed along at least a front edge of the recessed portion of the second housing, and further comprising a fastener located along a rear wall of the first and second housings to secure the first housing to the second housing.

19. The assembly of claim 16, further comprising an electrical connector for electrically coupling the first housing to the second housing.

20. The assembly of claim 16, wherein the second housing includes a base for coupling the second housing to a third housing.

21. The assembly of claim 16, further comprising a mounting bar coupled to the first housing for mounting the first and second housings to a support.

22. The assembly of claim 21, further comprising a spring assembly for coupling the mounting bar to the first housing for movement relative to the first housing between a retracted storage position and an extended position to couple the first and second housings to the support, the spring assembly biasing the mounting bar to its retracted position.

23. An apparatus for reducing noise of intake air into an aperture formed in a wall of a blower motor, the apparatus comprising a ring including an annular outer flange having a dimension larger than the aperture in the wall of the blower motor, an annular inner portion configured to extend through the aperture, and a tapered surface extending between the outer flange and the inner portion to minimize noise caused by air entering the blower motor through the aperture, a distal end of the inner portion having a dimension larger than the aperture, the inner portion being flexible to permit the inner portion to be inserted into the aperture so that the inner portion retains the ring on the wall of the blower motor.

24. An apparatus for reducing noise of intake air into an aperture formed in a wall of a blower motor, the apparatus comprising an intake manifold having a front wall formed to include an outlet opening configured to be aligned with the aperture, a ring including an annular outer flange having a dimension larger than the aperture in the wall of the blower motor, an annular inner portion configured to extend through the aperture, and a tapered surface extending between the outer flange and the inner portion to minimize noise caused by air entering the blower motor through the aperture, the outer flange of the ring being configured to engage the front wall of the manifold to secure the manifold to the blower motor.

25. The apparatus of claim 24, wherein the intake manifold includes a baffle to direct air flow through the intake manifold.

26. The apparatus of claim 25, wherein the manifold includes a rear wall and a side wall extending between the front wall and rear wall, the side wall being formed to include an air inlet opening.

27. The apparatus of claim 26, further comprising sound foam located within an interior region of the manifold adjacent the front and rear walls.

28. The apparatus of claim 24, wherein a distal end of the inner portion has a dimension larger than the aperture in the wall of the blower motor, the inner portion being flexible to permit the inner portion to pass through the outlet opening of the manifold and into the aperture so that the inner portion of the ring retains the ring and the intake manifold on the wall of the blower motor.

29. A blower apparatus comprising:

a housing for holding a blower motor, the housing having an air outlet and a recessed grate formed to include a plurality of slots spaced apart along an axis to provide an air inlet;

a filter located over the recessed grate; and a cover coupled to the housing over the recessed grate and filter, the cover being formed to include a plurality of slots spaced apart along the axis, the slots of the cover being axially spaced apart from the slots in the recessed grate.

30. The blower apparatus of claim 29, wherein the housing includes a first housing portion and a second housing portion coupled to the first housing portion.

31. The blower apparatus of claim 30, wherein the first and second housing portions cooperate to define the recessed grate.

32. The blower apparatus of claim 29, wherein the plurality of slots in the cover are positioned in first and second spaced apart columns.

33. The blower apparatus of claim 32, wherein the housing includes a first housing portion and a second housing portion coupled to the first housing portion, the first housing portion being formed to include a recessed grate having a plurality of slots aligned with the first column of slots in the cover, and the second housing portion being formed to include a recessed grate having a plurality of slots aligned with the second column of slots in the cover.

34. An apparatus for mounting a blower motor into a blower housing having an interior region for receiving the blower motor, the apparatus comprising a top shell configured to surround a top portion of the blower motor, and a bottom shell configured to surround a bottom portion of the blower motor, the top and bottom shells being configured to hold the blower motor in the interior region of the housing without a rigid connection between the blower motor and the blower housing, the top and bottom shells cooperating to define an outlet manifold in communication with an outlet of the blower motor.

35. The apparatus of claim 34, wherein the top and bottom shells are made from a foam material.

36. The apparatus of claim 34, wherein the blower motor has a top surface formed to include an air inlet aperture, the top shell having an inner surface located above the top surface of the blower motor, the inner surface being formed to include a recessed portion located over the inlet aperture to permit intake air to enter the inlet aperture.

37. The apparatus of claim 34, wherein the top and bottom shells also cooperate to define an air intake manifold to provide flow of intake air to the blower motor.

38. An apparatus for mounting a blower motor having a top surface formed to include an air inlet aperture into an interior region of a blower housing, the apparatus comprising a top shell configured to surround a top portion of the blower motor, and a bottom shell configured to surround a bottom portion of the blower motor, the top and bottom shells being configured to hold the blower motor in the interior region of the housing without a rigid connection between the blower motor and the blower housing, the top shell having an inner surface located above the top surface of the blower motor, the inner surface being formed to include a recessed portion located over the inlet aperture to permit intake air to enter the inlet aperture.

* * * * *